United States Patent [19]

Hensgen et al.

[11] Patent Number: 4,870,748

[45] Date of Patent: Oct. 3, 1989

[54] APPARATUS FOR ASSEMBLING ELEMENTS OF A SMOKING ARTICLE

[75] Inventors: Gerhard Hensgen, Hamburg; Wolfgang Steiniger, Bornsen; Werner Hinz, Lauenburg; Erwin Oesterling, Glinde; Siegfried Schlisio, Geesthacht, all of Fed. Rep. of Germany

[73] Assignee: R. J. Reynolds Tobacco Co., Winston-Salem, N.C.

[21] Appl. No.: 74,811

[22] Filed: Jul. 17, 1987

[51] Int. Cl.[4] ..... A24C 5/18; B23P 21/00

[52] U.S. Cl. ..... 29/773; 131/84.1; 131/94; 131/369

[58] Field of Search ..... 29/776, 773; 53/151; 131/77, 84.1, 94, 108, 369, 273; 198/461

[56] References Cited

U.S. PATENT DOCUMENTS

| | | | |
|---|---|---|---|
| Re. 25,917 | 11/1965 | Stelzer | 93/1 |
| 1,559,322 | 10/1925 | Hohn . | |
| 3,096,772 | 7/1963 | Korber | 131/66 |
| 3,199,418 | 8/1965 | Schubert | 93/1 |
| 3,368,460 | 2/1968 | Schubert | 93/1 |
| 3,736,941 | 6/1973 | Molins et al. | 131/21 R |
| 3,957,062 | 5/1976 | Labbe et al. | 131/84 B |
| 3,987,804 | 10/1976 | Molins et al. | 131/84 B |
| 4,200,179 | 4/1980 | Hinz | 198/458 |
| 4,207,720 | 6/1980 | Tolasch et al. | 53/151 |
| 4,237,778 | 12/1980 | Hausler et al. | 493/39 |
| 4,238,994 | 12/1980 | Koch | 493/4 |
| 4,487,001 | 12/1984 | Tolasch et al. | 53/151 |
| 4,489,534 | 12/1984 | Gomann et al. | 53/151 |
| 4,714,082 | 12/1987 | Banerjee et al. | 131/359 |

FOREIGN PATENT DOCUMENTS

| | | |
|---|---|---|
| 0174645 | 3/1986 | European Pat. Off. . |
| 0212234 | 3/1987 | European Pat. Off. . |
| 2715994 | 10/1986 | Fed. Rep. of Germany . |

OTHER PUBLICATIONS

Hauni-Werke Korber & Co. KG, Hamburg, Germany, Brochure No. 1, Re: Cigarette Manufacture, 1983 Edition.

Hauni-Werke Korber & Co. KG, Hamburg, Germany, Brochure No. 2, Re: Filter Rod Production, 1983 Edition.

Hauni-Werke Korber & Co. KG, Hamburg, Germany, Brochure No. 3, Re: Transfer Systems, 1983 Edition.

*Primary Examiner*—Timothy V. Eley

*Attorney, Agent, or Firm*—Grover M. Myers; David G. Conlin

[57] ABSTRACT

An apparatus for making smoking articles is described. The preferred apparatus comprises structure to form a passage axially through a jacketed rod of tobacco, at one end of which there is a tubular sleeve of non-combustible material, and to insert an aerosol generating cartridge containing an aerosol forming substance, at one end of which there is a fuel element, into the passage so that the aerosol forming substance is within the passage in the rod of tobacco and the fuel element is within the sleeve of non-combustible material.

74 Claims, 12 Drawing Sheets

APPARATUS FOR ASSEMBLING ELEMENTS OF A SMOKING ARTICLE

BACKGROUND OF THE INVENTION

In European Patent Publication Nos. 0174645(A2) and 0212234(A2), the disclosures of which are hereby incorporated by reference, there are disclosed a number of alternative forms of smoking articles which typically embody (1) an aerosol generating cartridge comprising a fuel element for generating heat for transfer to an aerosol forming material which may contain a tobacco flavoring material, (2) a sleeve or jacket circumscribing the cartridge, the sleeve preferably including an insulating material around the fuel element and a tobacco containing material around the aerosol forming material and, optionally, (3) a mouthend piece, which may contain a filter element. Generally, the aerosol generating cartridge of the smoking article comprises a capsule containing an aerosol generating material with a fuel element at one end.

It is a purpose of this invention to provide high speed production apparatus for combining such aerosol generating cartridges and sleeves to form aerosol generating modules.

SUMMARY OF THE INVENTION

In accord with the present invention, an apparatus for making modules, particularly aerosol generating modules for smoking articles is provided. The apparatus comprises (1) a rotatable drum, (2) a plurality of stations mounted around the drum, each station comprising jacket holding means for receiving and holding at least one jacket segment, and cartridge holding means for receiving and holding at least one cartridge or capsule, and (3) means for inserting cartridges into jacket segments, thereby forming modules for smoking articles. Preferably, the jacket segments comprise tobacco and the cartridges contain an aerosol generating material. Typically, the apparatus comprises jacket supply means for supplying jacket segments and cartridge supply means for supplying aerosol generating cartridges to the stations and means for removing the aerosol generating modules from each of the stations, in seriatim. Preferably, each station forms a plurality of aerosol generating modules in parallel.

In one preferred embodiment of the invention, the stations are preferably arranged in axially aligned mirror image pairs or tandem pairs around the periphery of the drum so that operations can take place in parallel at each pair of stations as the drum rotates. The stations preferably each include means for inserting cartridges into jacket segments.

In certain preferred embodiments in which the jacket segments comprise a sleeve of material preformed around a support member, such as a tube, the apparatus includes means for ejecting the support member from the jacket segments, preferably while an aerosol generating cartridge is being inserted into the jacket segment.

In another preferred embodiment, the apparatus further comprises means for forming a passage lengthwise in the jacket segment, and the aerosol generating cartridge is inserted into the passage.

In a particularly preferred embodiment, the passage is formed in the jacket segment by a passage forming member and the apparatus has means for withdrawing the passage forming member and simultaneously inserting the aerosol generating cartridge. In instances where a portion of the jacket segment is formed around a support member, such as a tube, the withdrawing and inserting means also preferably includes means for ejecting the support member from the jacket segment while the cartridge is being inserted therein.

In the preferred drum configuration, means for ejecting a support member, insertion means and passage forming means, if required, are located at each station. Each station also preferably includes a slidable support means, which supports the jacket holding means and the cartridge holding means, and means cooperating with the jacket holding means for restraining movement of the jacket segment during passage formation and/or insertion of the cartridge. Preferably, the insertion means comprises an abutment member located proximate the cartridge holding means during insertion and means for effecting relative movement between the slidable support means and the abutment member to accomplish insertion of the cartridge at least partially into the jacket segment.

In one embodiment of the invention, means operable in connection with the rotation of the drum position the jacket segment and cartridge on the drum for insertion of the cartridge into the jacket segment and accomplish the insertion. When the jacket segment comprises a rod of material without a preformed passage, each station includes a passage forming means which forms a passage in the rod as the drum rotates. The aerosol generating cartridge is then inserted into the passage, and the completed module is removed from the station upon further rotation of the drum, leaving the station ready to receive another jacket segment and begin the cycle once again. When the jacket segment comprises a tube surrounded by a sleeve of material, each station includes means for rejecting the tube, preferably as the cartridge is inserted.

More specifically, one preferred embodiment of an apparatus for assembling components of a preferred smoking article according to this invention comprises a drum and a plurality of stations mounted on the drum, the stations preferably mounted in axially aligned pairs around the drum. Each of the stations comprises at least one spindle, means supporting the spindle for rotation about its longitudinal axis, a slidable abutment member, means supporting the abutment member in axially-spaced alignment with the axis of the spindle, transport means comprising a reciprocally movable support means or carriage embodying axially aligned recesses for receiving first and second components of the smoking article, and a restraining means or clamp movable in unison with, and relative to, the carriage. Preferably, each station includes two or more spindles, abutment members and sets of aligned recesses for the components, so that a plurality of sets of components may be simultaneously assembled at each station.

The restraining means or clamp is preferably operable, by movement relative to the carriage, to enclose the first components on the carriage. The clamp then moves with the carriage toward the spindle and into engagement with the spindle whereby the spindle pierces the first component. Thereafter, the clamp moves with the first component in an opposite direction, in unison with the carriage toward the abutment member to withdraw the pierced first component from the spindle, and impaling it on the second component. Thereafter, the clamp moves relative to the carriage to release the composite structure comprising the first component with the second component inserted therein.

Rotation of the drum effects movement of the carriage and clamp as aforesaid. Desirably, the spindle is rotated, and there is means operable by rotation of the drum relative to the supporting frame to effect rotation of the spindle such as, for example, a train of gears.

Apparatus in accord with the present invention may additionally comprise means for supplying a mouthend piece and means for joining the mouthend piece to the aerosol generating module to form a cigarette type smoking article. In another embodiment, the apparatus may include means for inserting mouthend piece modules between two aerosol generating modules to make a composite structure that, when cut in half, forms two smoking articles.

BRIEF DESCRIPTION OF THE DRAWINGS

The invention will now be described in detail with reference to the accompanying drawings, wherein.

DETAILED DESCRIPTION OF THE PREFERRED EMBODIMENTS OF THE INVENTION

Figure 3:
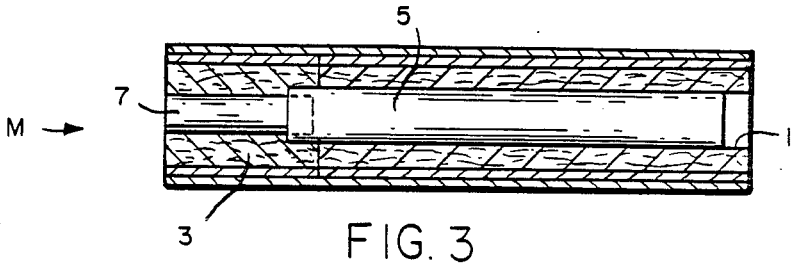
FIG. 3 is a longitudinal section illustrating an aerosol generating module M consisting of aerosol generating cartridge B of FIG. 2 incorporated in jacket segment A of FIG. 1.

The apparatus of the present invention is designed to insert an aerosol generating cartridge in a jacket segment, thereby forming an aerosol generating module, of the type as generally illustrated in FIG. 3.

Figure 1:
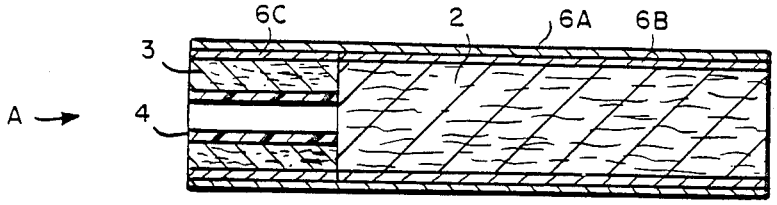
FIG. 1 is a longitudinal section of a jacket segment A comprising a rod of tobacco, at one end of which there is a sleeve of insulating material surrounding a tubular support member.
Figure 2:
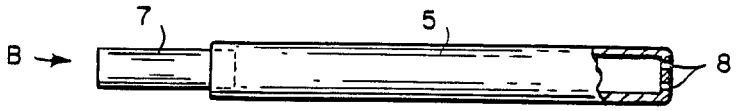
FIG. 2 is an elevation, partly in section, of an aerosol generating cartridge B comprising a capsule containing an aerosol forming material, at one end of which there is a fuel element.

Referring to the drawings, FIGS. 1, 2, and 3, and in accordance with the invention, a preferred apparatus is structured to form a longitudinal opening or axial passage 1 (FIG. 3) in an elongate jacket segment "A" and insert an aerosol generating cartridge "B" into opening 1.

As illustrated in FIG. 1, a preferred jacket segment "A" comprises a rod 2 of fibrous material, such as tobacco, volume expanded tobacco, reconstituted tobacco materials, combinations thereof, or other materials. At one end of rod 2 there is a sleeve 3 of insulating material, in this case non-combustible fibers, such as glass fibers. Within the sleeve, there is a tubular support member 4. The rod 2 and sleeve 3 are circumscribed and joined by means of paper wrappers 6A, 6B, and 6C, such as customarily used in the manufacture of smoking articles such as cigarettes.

Although the jacket segment illustrated in FIG. 1 comprises a preformed sleeve portion and a rod of fibrous material portion, jacket segments for smoking articles that may be combined by apparatus of the present invention may also comprise (1) only a sleeve portion preformed about a support member, (2) a sleeve without a support member, (3) only a rod, or (4) other variations having portions that comprise a sleeve, which may be preformed, a rod, or combinations thereof. In such cases, the apparatus of the present invention can be modified in accord with the teachings herein. For instance, if the jacket segment comprises only a rod portion, a spindle or other passage forming means would normally be used to form a passage suitable for inserting the cartridge therein. Alternatively, the cartridge itself may be suitably shaped to be inserted into the rod without prior forming of a passage. If the jacket segment comprises only a sleeve portion, the apparatus of the invention would be modified accordingly, for instance, to eliminate the spindle and to eject any support member, preferably as the aerosol generating cartridge is inserted into the jacket segment.

The preferred aerosol generating cartridge "B" (FIG. 2) is an elongate capsule 5, advantageously of circular cross section, containing an aerosol forming material and having one or more holes 8 at one end for release of aerosol. A heat generating element 7, preferably in the form of a carbon plug, is inserted in the other end of capsule 5. Other configurations of the aerosol generating cartridge, such as the various aerosol generating means described in the aforesaid European Patent Publications, may also be used.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating cartridge or capsule, or elsewhere in the article. As so defined, the term "aerosol" also includes volatile or sublimeable flavoring agents and/or pharmacologically or physiologically active agents, irrespective of whether they produce a visible aerosol.

Figure 4:
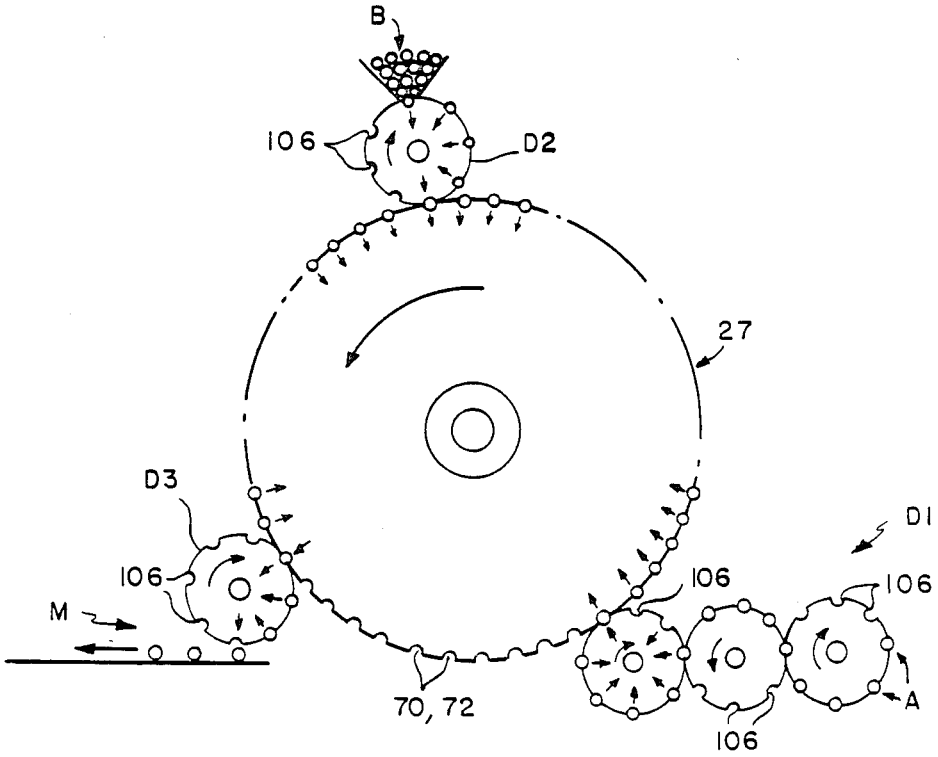
FIG. 4 diagrammatically shows one embodiment of an apparatus in accord with the present invention, comprising a rotating drum, with rotary transfer drums D1 and D2 for depositing smoking article components (e.g., jacket segments A and aerosol generating cartridges B) thereon, and rotary transfer drum D3 for removing the composite structure M therefrom.
Figure 5:
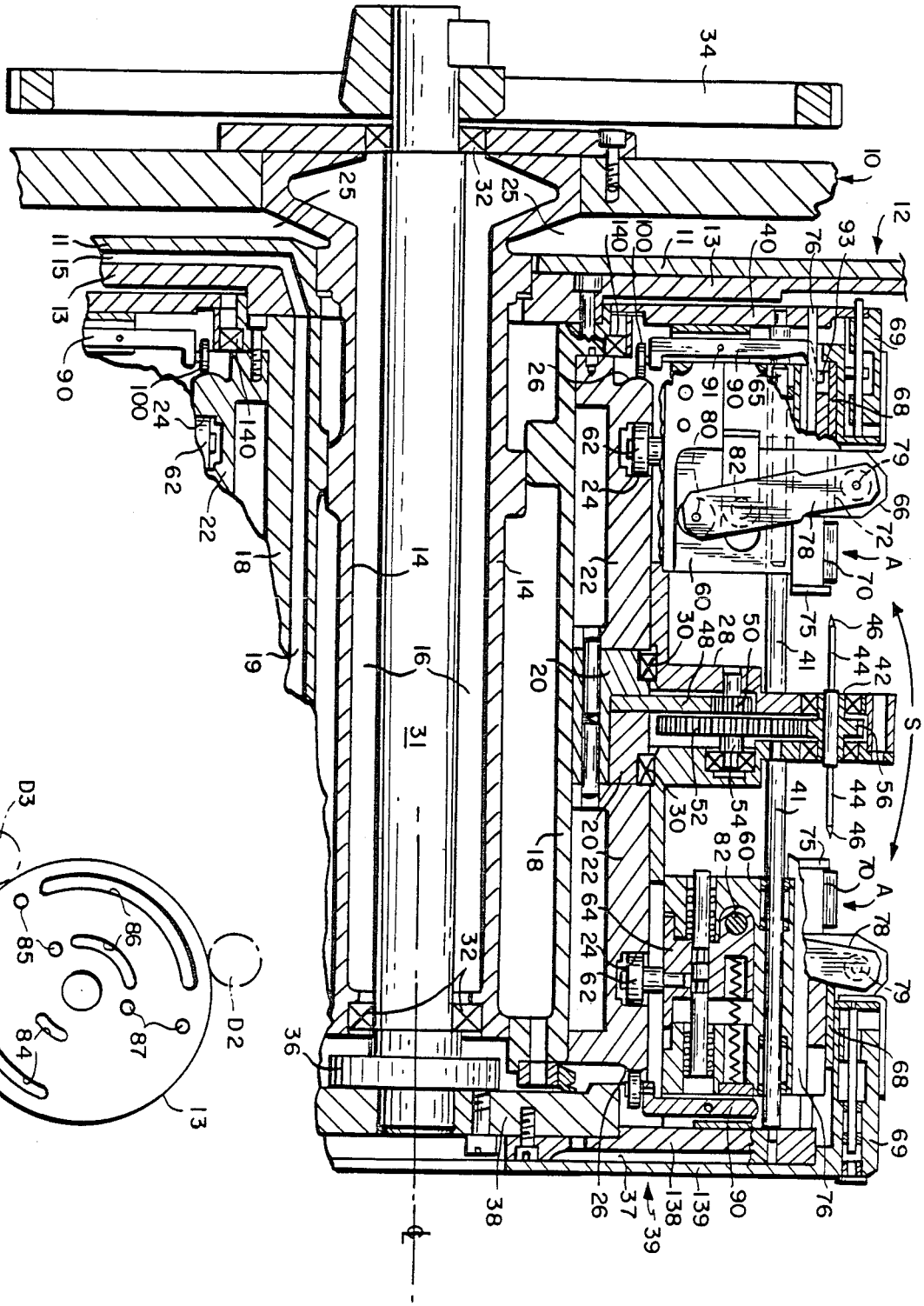
FIG. 5 is a fragmentary longitudinal view of an adjacent or tandem pair of stations in a preferred embodiment of the apparatus, having various sectional views rotated about the axis to more clearly illustrate various features of the apparatus, and showing jacket segments A positioned thereon.
Figure 10:
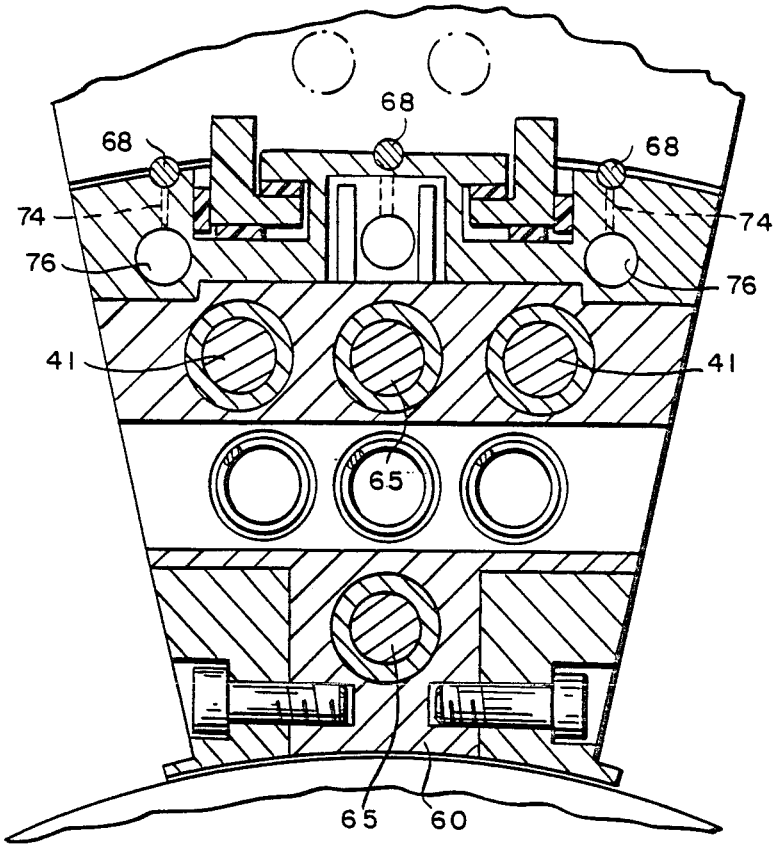
FIG. 10 is a fragmentary section taken along the line 10—10 of FIG. 6.
Figure 11A:
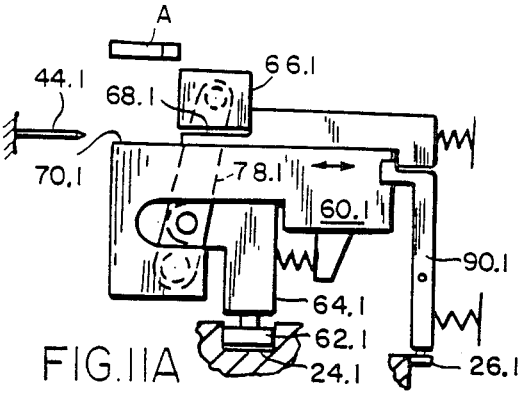
FIGS. 11-A to 11-H are partial elevational views that schematically illustrate the successive operations of one station of the apparatus of FIG. 5 entailed in combining the jacket segment and cartridge.
Figure 11E:
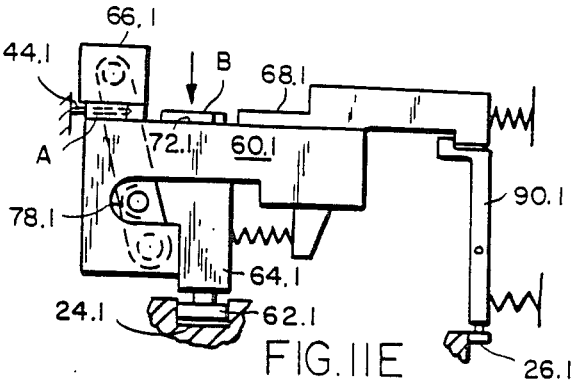
Figure 11B:
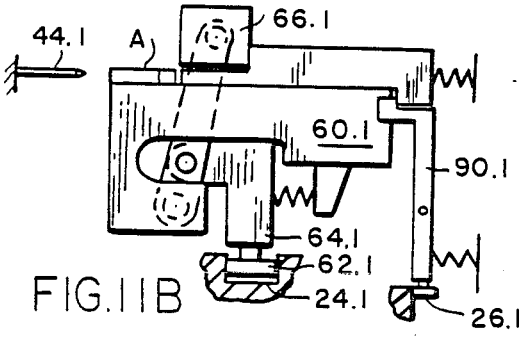
Figure 11F:
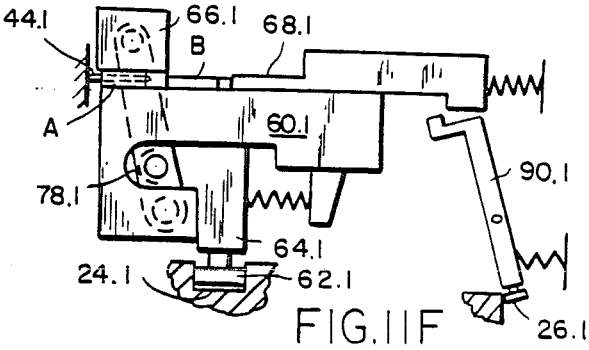
Figure 11C:
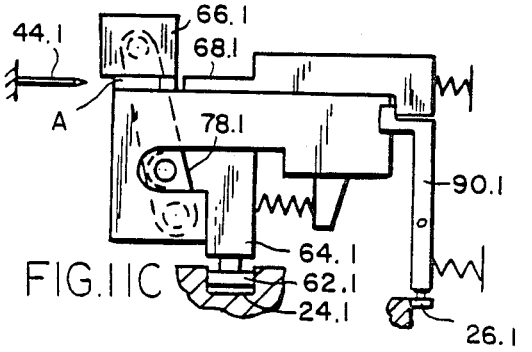
Figure 11G:
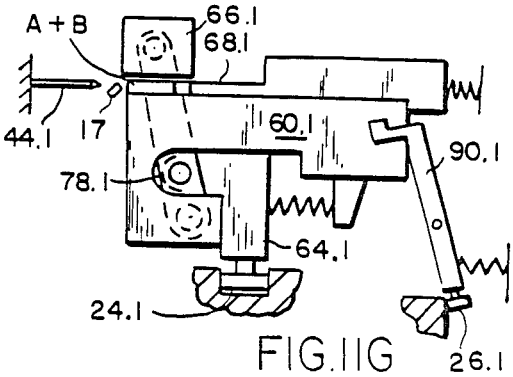
Figure 11D:
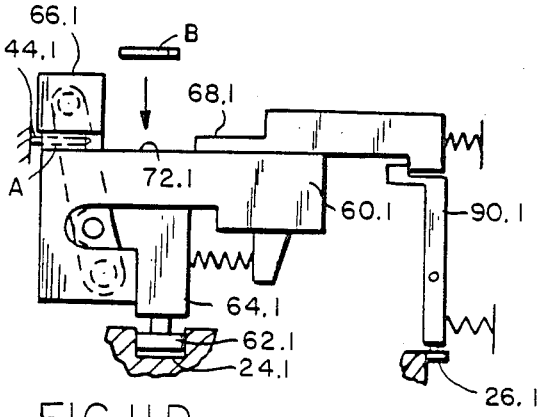
Figure 11H:
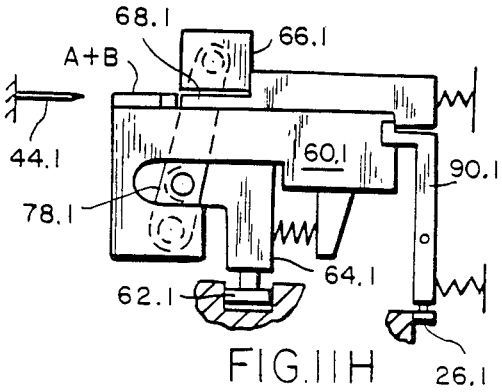
Figure 12A:
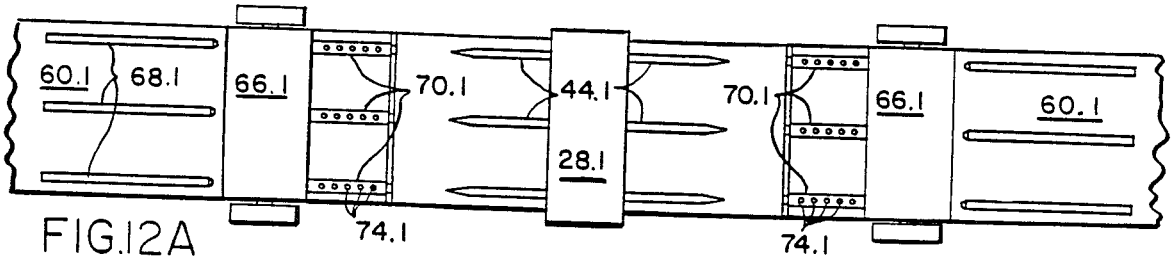
FIGS. 12-A to 12-0 are partial plan views schematically illustrating the successive operations of one station of the apparatus of FIG. 5 entailed in combining the jacket segment and the cartridge.
Figure 12B:
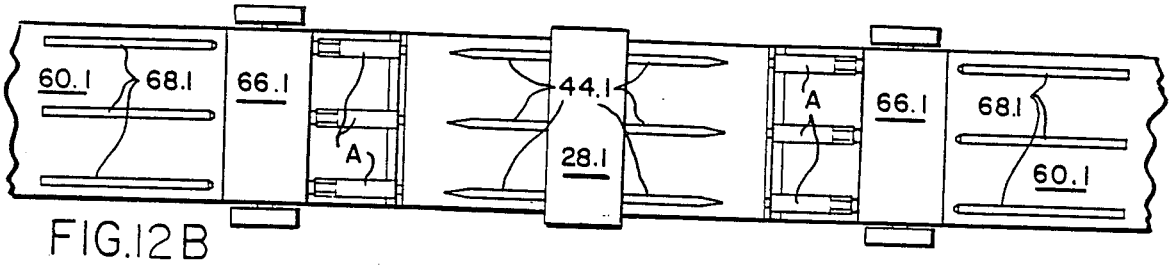
Figure 12C:
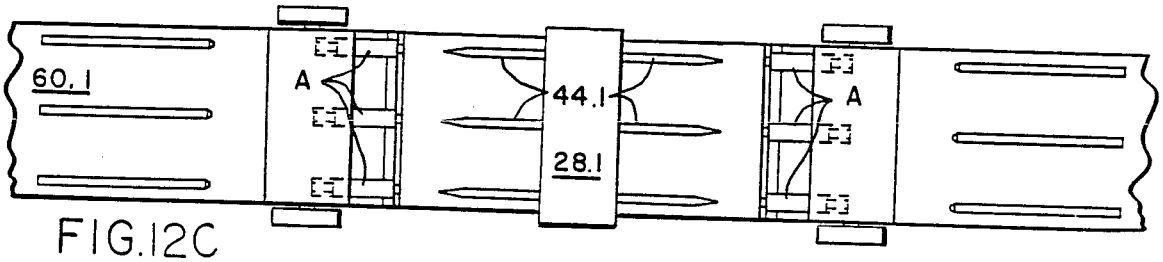
Figure 12D:
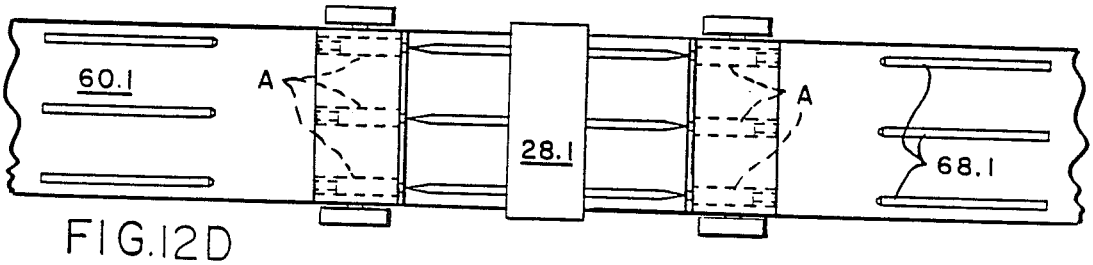
Figure 12E:
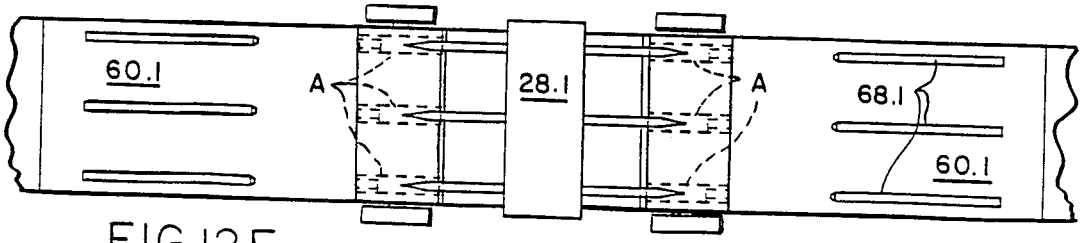
Figure 12F:
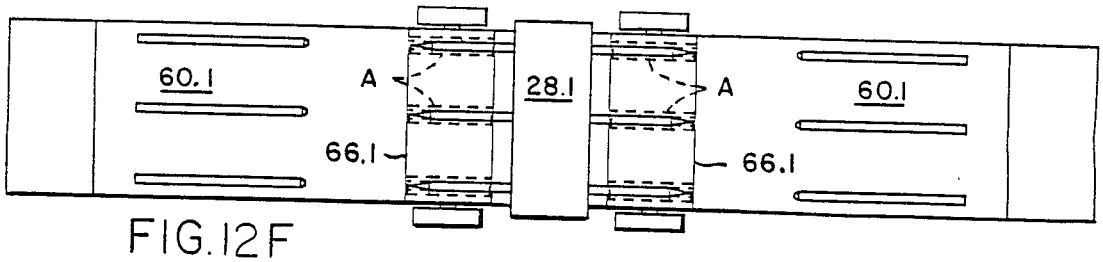
Figure 12G:
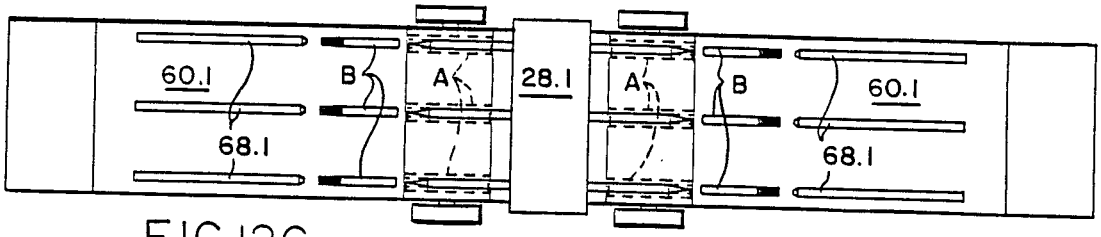
Figure 12H:
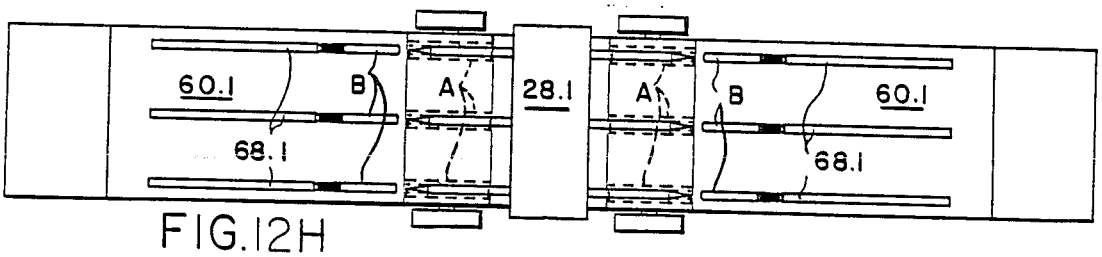
Figure 12I:
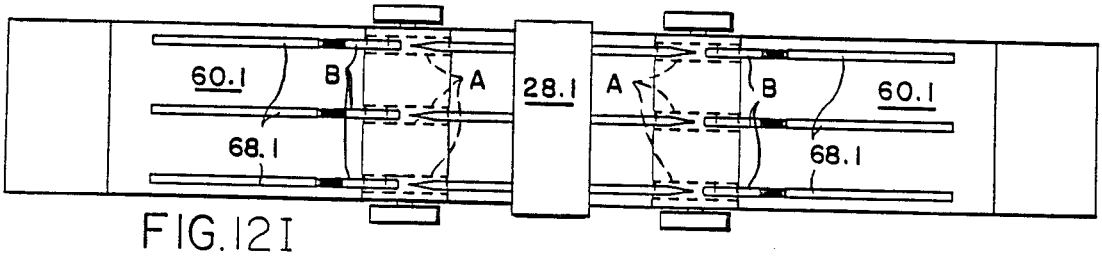
Figure 12J:
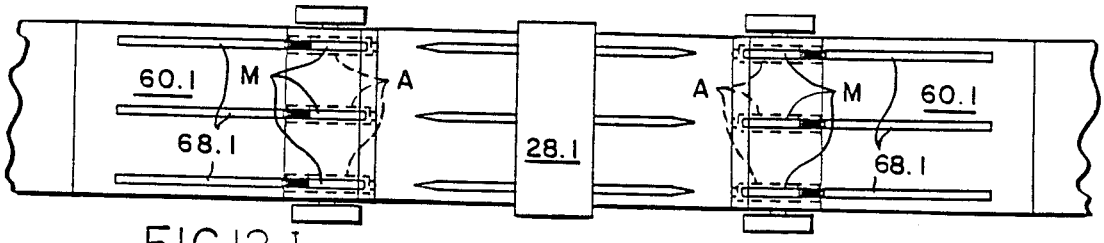
Figure 12K:
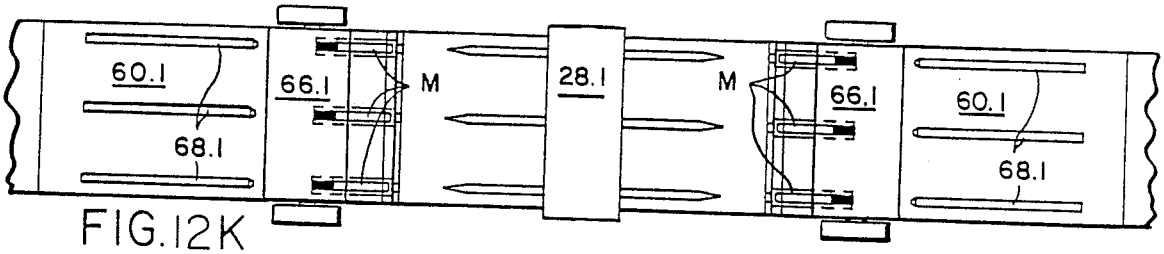
Figure 12L:
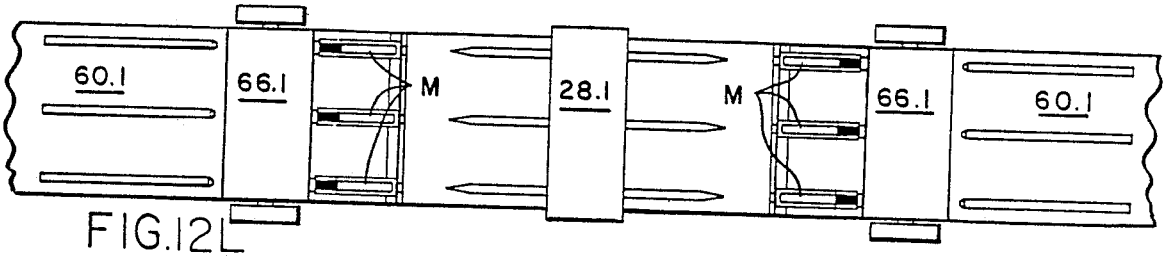
Figure 12M:
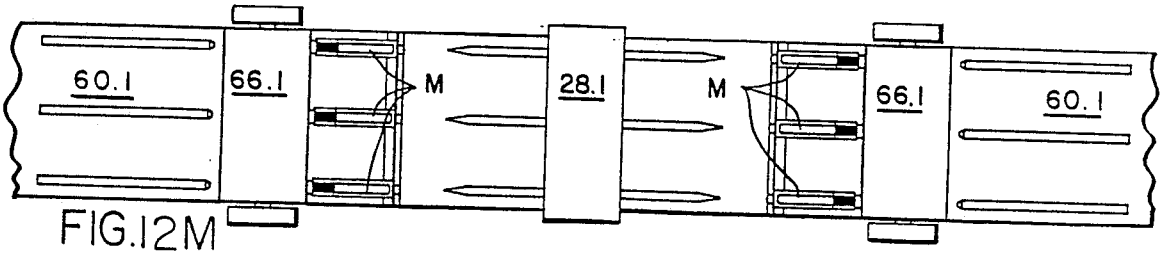
Figure 12N:
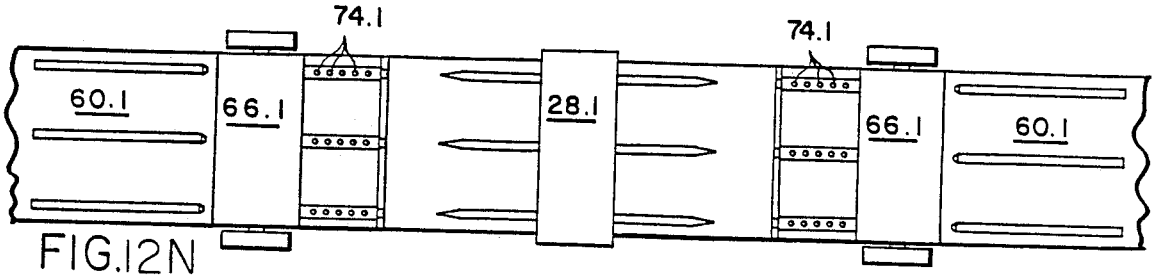
Figure 12O:
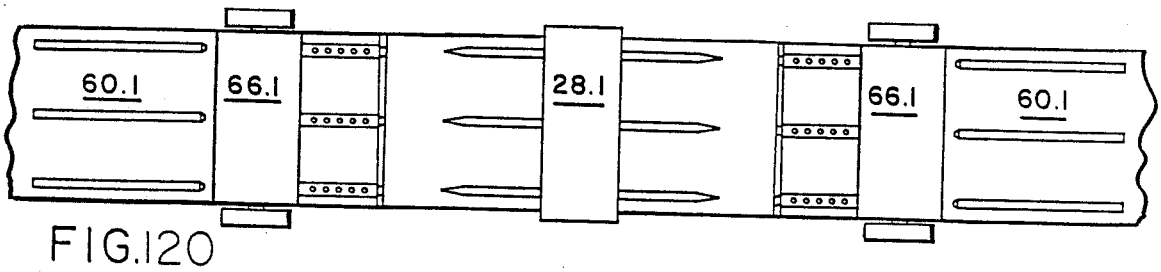

A preferred apparatus in accord with the invention generally comprises a rotating assembly drum, generally indicated by reference numeral 27 of FIG. 4. Referring specifically to FIG. 5, the apparatus has a plurality of stations "S" typically designed in essentially axially aligned mirror image pairs forming parallel tracks of stations, each station comprising a carriage 60 and a clamp 66, and a plurality of spindles 44, recesses 70, 72, abutment members 68, etc., so that two sets of aerosol generating modules may be assembled in parallel. As shown in the illustrated embodiment, each station is designed to simultaneously assemble three aerosol generating modules. (See FIG. 10 and FIG. 12-A-12-0)

As shown in FIG. 4, preferably there are transfer drums D1, D2 and D3 disposed about the assembly drum 27 for rotation in timed relation to drum 27 for depositing the components "A" and "B" in the recesses 70 and 72 on each station, in timed relation with the movement of the carriage 60 and clamp 66, and for removing the aerosol generating modules M from the drum after assembly. Transfer drum D1 is preferably located on the upgoing side of drum 27 for depositing jacket segments "A" in recesses 70. Transfer drum D2 is preferably located near the top of drum 27 for depositing cartridges "B" in recesses 72. Transfer drum D3 is preferably located on the downgoing side of the drum 27 for removing the combined aerosol generating modules "M." The transfer drums are provided with recesses 106 for receiving the components and vacuum means depicted by the arrows for holding them in place on the transfer drums before or after transfer.

Typically, the jacket segments are fed directly from a suitably modified conventional type segment combining machine (not shown), such as a Hauni MULFI, by a series of vacuum assisted transfer drums D1. Such drums are used to position two or more jacket segments laterally to line up with the parallel tracks of stations on drum 27. The jacket segments can also be fed from trays or hoppers using suitably arranged vacuum assisted rotary devices or equivalent means.

Typically, the cartridges are fed from trays or hoppers positioned above assembly drum 27 using transfer drum D2, or other suitably arranged vacuum assisted rotary devices or equivalent means.

The completed aerosol generating modules "M" may be deposited on a belt as in FIG. 4 and transported for packaging. Alternatively, the modules can be transferred to a tipping machine by a series of rotary transfer drums or other equivalent means (not shown, where they are combined with mouthend pieces to form cigarette-type smoking articles.

Figure 13:
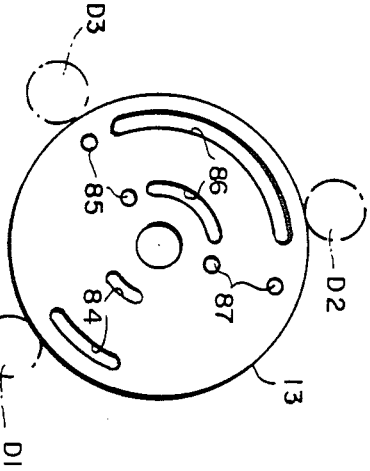
FIG. 13 diagrammatically shows, in relation to the transfer drums, the openings in mounting plate 12 that provide vacuum or low pressure air to the stations.

Again referring to FIG. 5, the drum apparatus comprises a supporting structure 10 to which is mounted a horizontally-disposed, tubular support 14 defining interiorly thereof an axial opening 16. A vertical mounting plate 12 is mounted on support 14 and attached to supporting structure 10 near the periphery of the drum (not shown). Mounting plate 12 consists of flat plate 11 and stepped plate 13. Flat plate 11 has grooves 15 radially formed in its inner surface, which in combination with stepped plate 13, provide passageways for low pressure air. Between supporting structure 10 and mounting plate 12 is a vacuum chamber 25. Passageways through mounting plate 12 at suitable locations provide vacuum to the stations "S". See 84, 86, in FIG. 13. A cylindrical sleeve 18 is mounted to the tubular support 14 in concentric relation thereto and attached to the stepped plate 13 of the mounting plate 12. Sleeve 18 has conduits 19 for communication of vacuum or low pressure air to the outside end of the drum. Passageways through plate 13 at suitable locations (85, 87) provide communication between chamber 25 and conduits 19. (FIG. 13)

Figure 8:
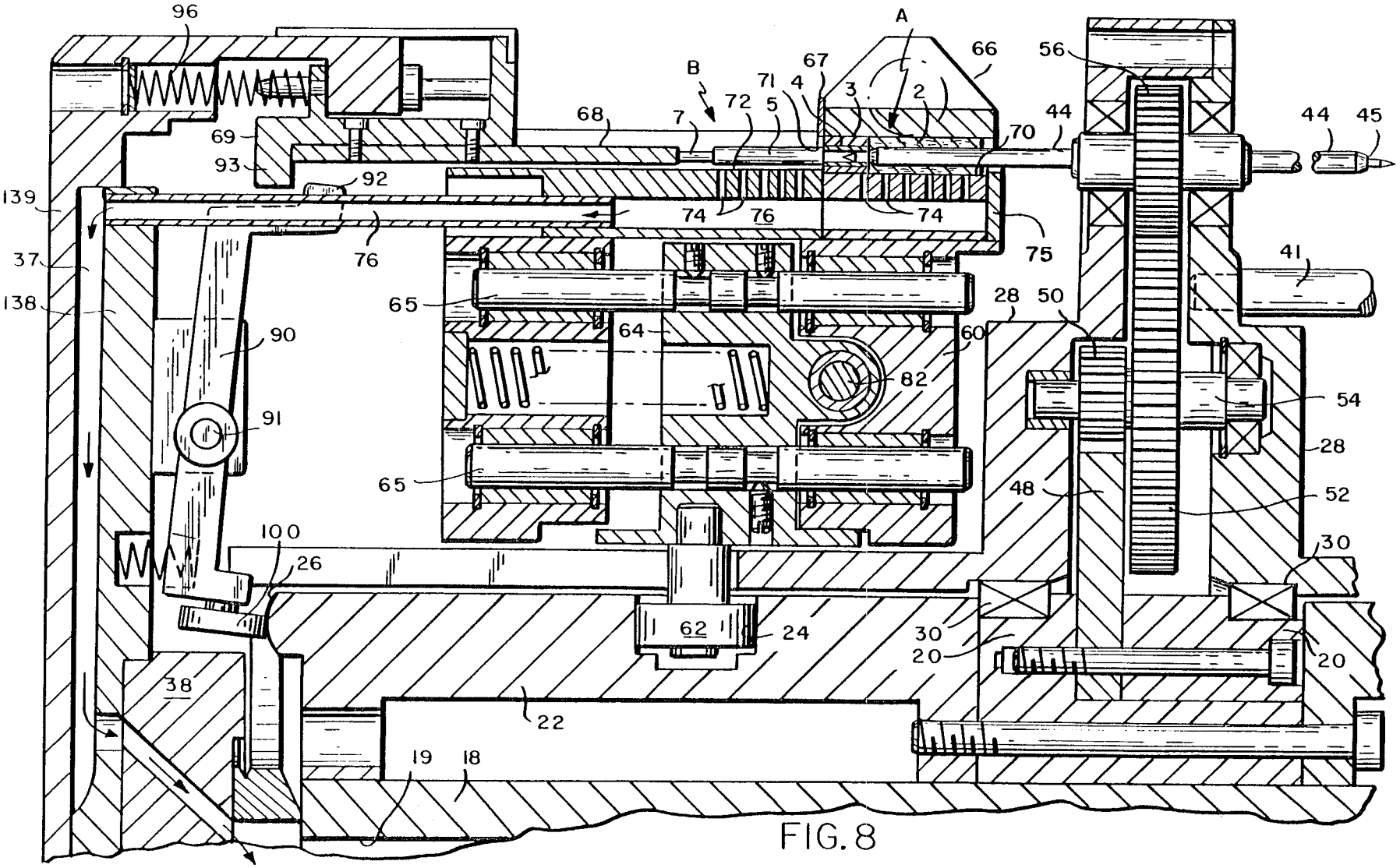
FIG. 8 is an enlarged fragmentary section showing the station of FIG. 6 with the jacket segment impaled on the spindle, and with the abutment member engaged with the cartridge, just prior to insertion of the cartridge into the jacket segment.

A hub 20 is non-rotatably mounted to the sleeve 18 midway between its opposite ends, and cam sleeves 22 are bolted to opposite sides of the hub. The cam sleeves 22 have on their cylindrical surfaces cam grooves 24 and at their ends profile cam surfaces 26. The hub 20 is conveniently made in two pieces to hold the annular ring gear 48 which is bolted thereto. (FIG. 8)

An annular support 28 is mounted to the hub 20 on axially-spaced annular bearing rings 30 for rotation about a horizontal axis. Rotation of the support 28 about the hub 20 is effected by a drive shaft 31 rotatably supported in bearings 32 within the tubular support 14. The shaft 31 has fixed to one end a drive gear 34 by means of which it can be rotated. At the other end of the shaft 31, there is fixed a radial flange 36. The radial flange 36 has bolted thereto a disk 38 and this, in turn, has bolted to it an outer end plate 39. The end plate 39 is conveniently formed in two sections. Plate 138 is attached to disk 38 and contains grooves 37 for forming passageways for vacuum and/or low pressure air to each outer station. Plate 139 is attached to plate 138 and completes the passageways. The passageways connect with conduit 19 in sleeve 18 for communication with mounting plate 12 and the source of vacuum or low pressure air.

An inner end plate 40 is rotatably mounted on sleeve 18 on ring bearing 140, adjacent to the stationary mounting plate 12. Vacuum and low pressure air are supplied to each of the inner stations directly through passageways 84, 85, 86, 87 in plate 13. See FIG. 13. Conduits 76 at each inner station extend through inner end plate 40 to a point in close proximity, preferably about 0.1 mm, to plate 13. This provides communication between the passageways in plate 13 and conduits 76 for the transmission of vacuum or low pressure air to the stations "S".

At each station, two shafts 41 are connected at one end to an end plate 39 (or 40) and at the other end to the support 28. These shaft 41 aid in providing structural support to the rotating components of the drum as rotation of the central shaft 31 effects rotation of the support 28.

Between each longitudinal or tandem pair of stations, the annular support 28 has peripherally thereof three rotatable bearing sleeves 42, in which there are mounted oppositely-facing rotatable spindles 44 having conical ends 46. Preferably, the conical end 46 of each spindle 44 has a shoulder 45 (as shown in FIG. 6) which is dimensioned to abut the edge of tube 4 in the jacket segment.

As best shown in FIG. 5, an annular ring gear 48 is mounted to the fixed hub 20, and between the station pairs, three annularly spaced spur gears 50 are mounted to the rotatable support 28 in mesh with the annular ring gear 48. The spur gears 50 are each fixed to a drive gear 52 which, in turn, is fixed to a shaft 54 journalled on the support 28 so that rotation of the support 28 about the hub 20 and ring gear 48 rotates each of the three drive gears 52. Each drive gear 52 meshes with one spindle gear 56 in a train of fourteen spindle gears 56, and thereby drives all fourteen spindle gears simultaneously. Each spindle gear 56 is mounted on a bearing sleeve 42 and thereby rotates a set of opposite-facing spindles 44. The spindle gears 56 at the end of each train of fourteen gears do not mesh with the end gear in the adjacent train of gears. To accomplish this, the gear teeth on these end gears are less than half the width of the gear and the partial width teeth on one end gear are on one side of the gear while the partial width teeth on the adjacent end gear are on the other side so that they do not mesh. Thus, rotation of the support 28 relative to the fixed hub 20, by way of the aforesaid gears, effects rotation of three trains of fourteen sets of spindles 44 about their horizontal axes which, as illustrated, are parallel to the axis of rotation of the drum.

At each station, a transport comprising a carriage 60 and a clamp 66 is slidably mounted on two horizontally-disposed shafts 41. The carriages 60 are movable axially along the shafts 41 relative to the spindles 44. To effect reciprocal movement, the carriages 60 are each provided with an internal coupling member 64, which is slidably mounted in carriage 60 on spindles 65 and spring biased toward rotating spindles 44. Each coupling member 64 has a cam follower 62 journalled in the cam groove 24 in cam sleeve 22. The cam grooves 24 are contoured so as to effect axial reciprocal movement of the coupling members 64 and, thus, carriages 60 when the assembly drum is rotated.

Figure 6:
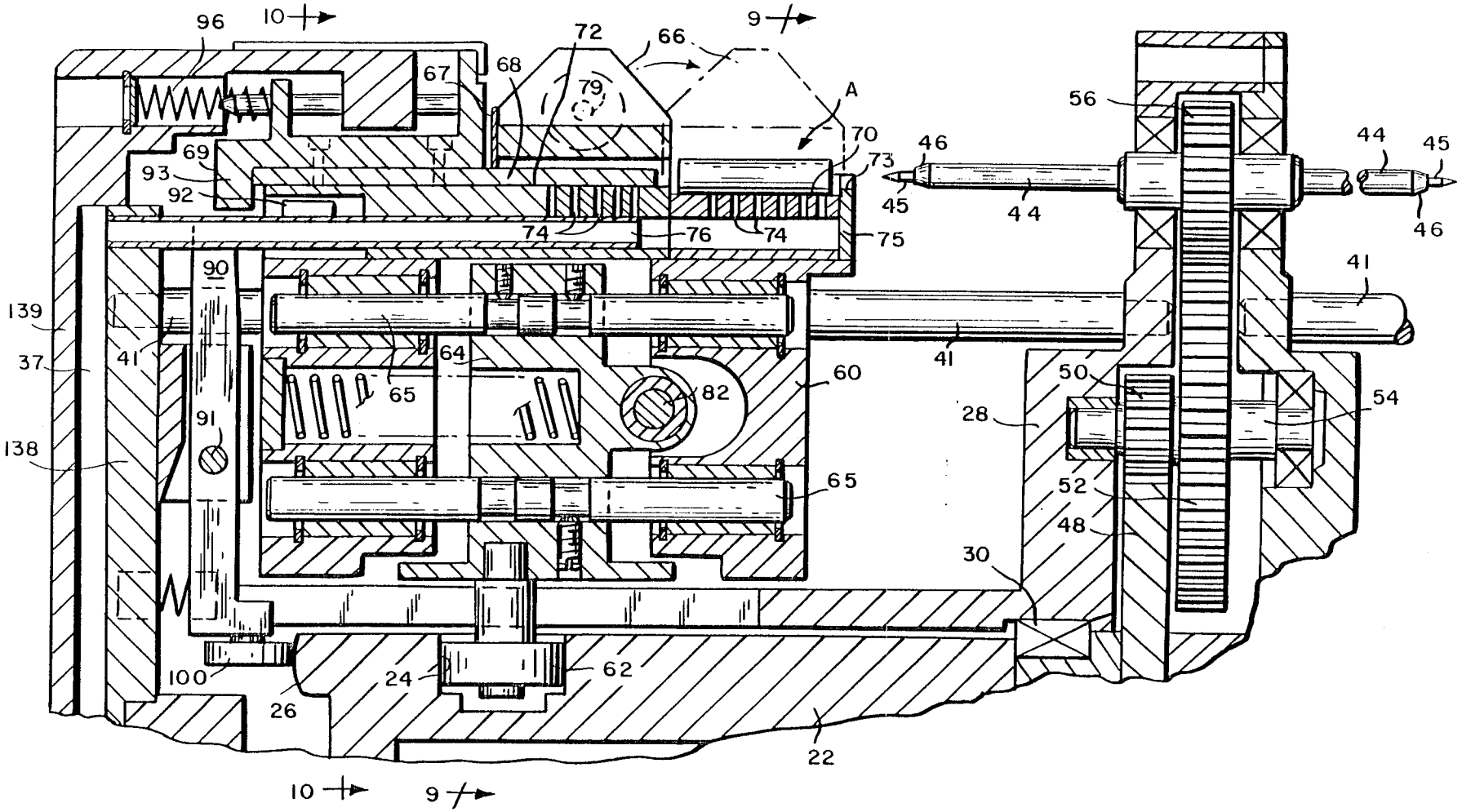
FIG. 6 is an enlarged fragmentary section showing one station of the apparatus of FIG. 5 in its initial position and having a jacket segment A positioned thereon.
Figure 7:
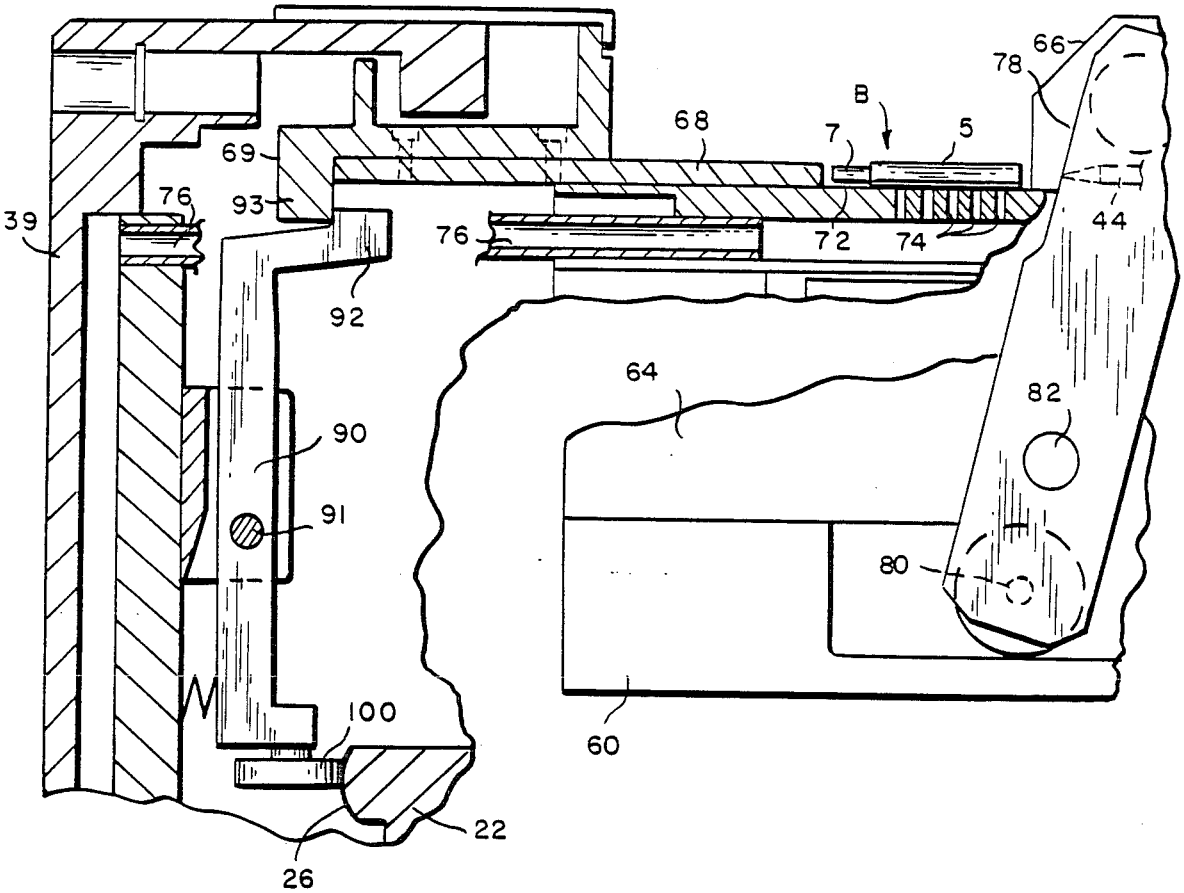
FIG. 7 is an enlarged fragmentary section showing the station of FIG. 6 in the position having the jacket segment impaled on the spindle and having a cartridge deposited thereon.

The clamps 66 are mounted to carriages 60 on support arms 78 which are pivotally coupled to the clamp at 79, to the carriages at 80, and to the coupling members 64 at shaft 82, FIGS. 6 and 7, for movement relative to the carriages 60 parallel to the axis of the spindles 44. Thus clamp movement also is effected by the contour of cam groves 24. Each clamp 66 has a retaining member 67, preferably vertically movable, located distally from the spindles to restrain lateral movement of the jacket segment as it is impaled on a spindle. The retaining member 67 can be mounted to clamp 66 on a leaf spring to permit movement in the upward direction when the cartridge moves under the retaining member, thereby avoiding jamming and breakage if there exists slight misalignment.

Figure 14:
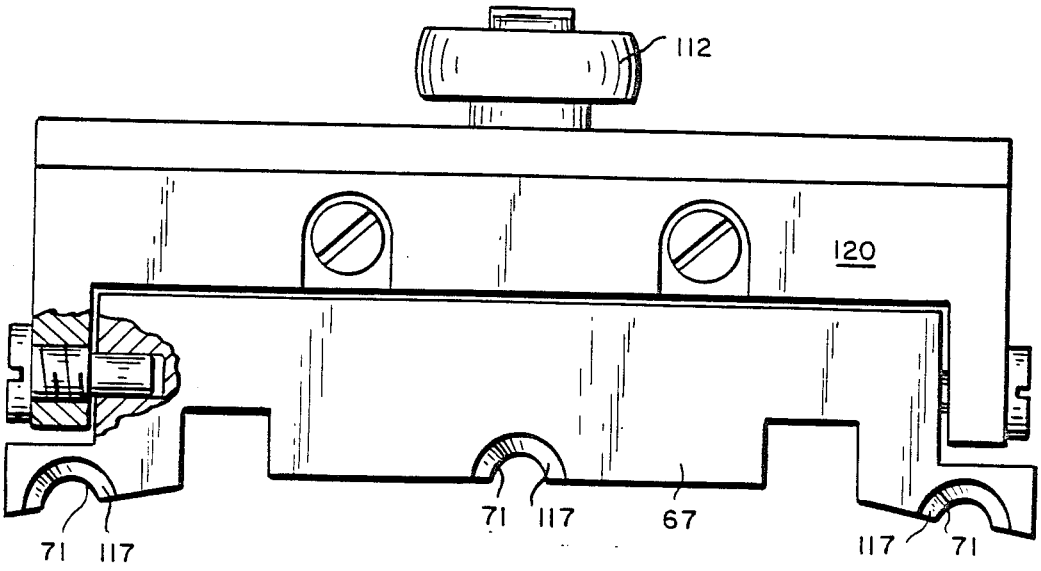
FIG. 14 is an elevation of a preferred structure for lifting retaining member 67 on clamp 66 for the step of inserting the cartridge "B" into jacket segment "A".
Figure 15:
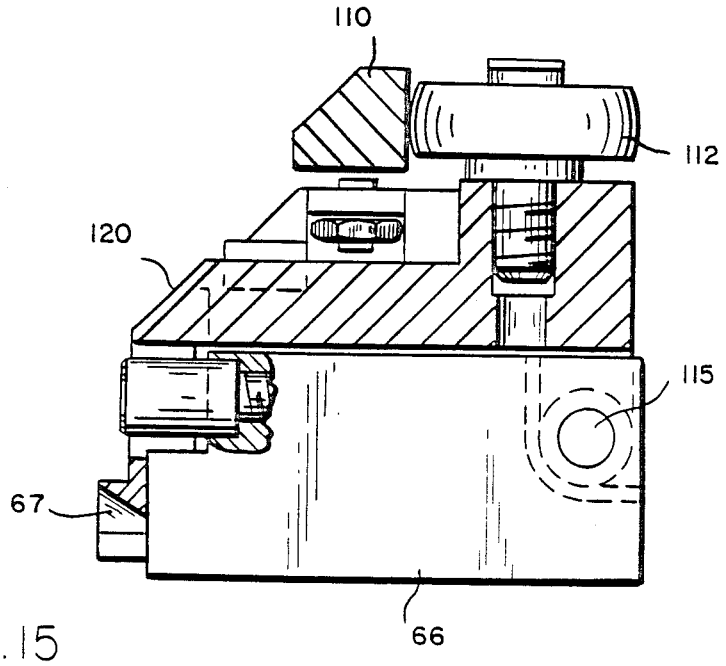
FIG. 15 is a side view, partly in section, of the structure of FIG. 14 illustrating the cam follower in contact with a cam surface to lift the retaining member.

FIGS. 14 and 15 illustrate a preferred structure for lifting retaining member 67 for the step of inserting cartridge "B" into jacket segment "A". The structure has a support bridge 120 to which is mounted retaining member 67 and a cam follower 112. The support bridge 120 is pivotally mounted at 115 to clamp 66. Preferably, the retaining member 67 has tapered surfaces 117 from its outward face to the openings 71 that align with the recesses 70, 72 on carriage 60. When the cam follower 112 contacts cam surface 110 (which is stationary, mounted (not shown) e.g. to the frame for drum 27) for the insertion step, cam surface 110 moves cam follower 112 (to the right in FIG. 15) to cause support bridge 120 to pivot at 115 thereby lifting retaining member 67 to permit cartridge "B" to pass through opening 71 without hitting the retaining member.

Figure 9:
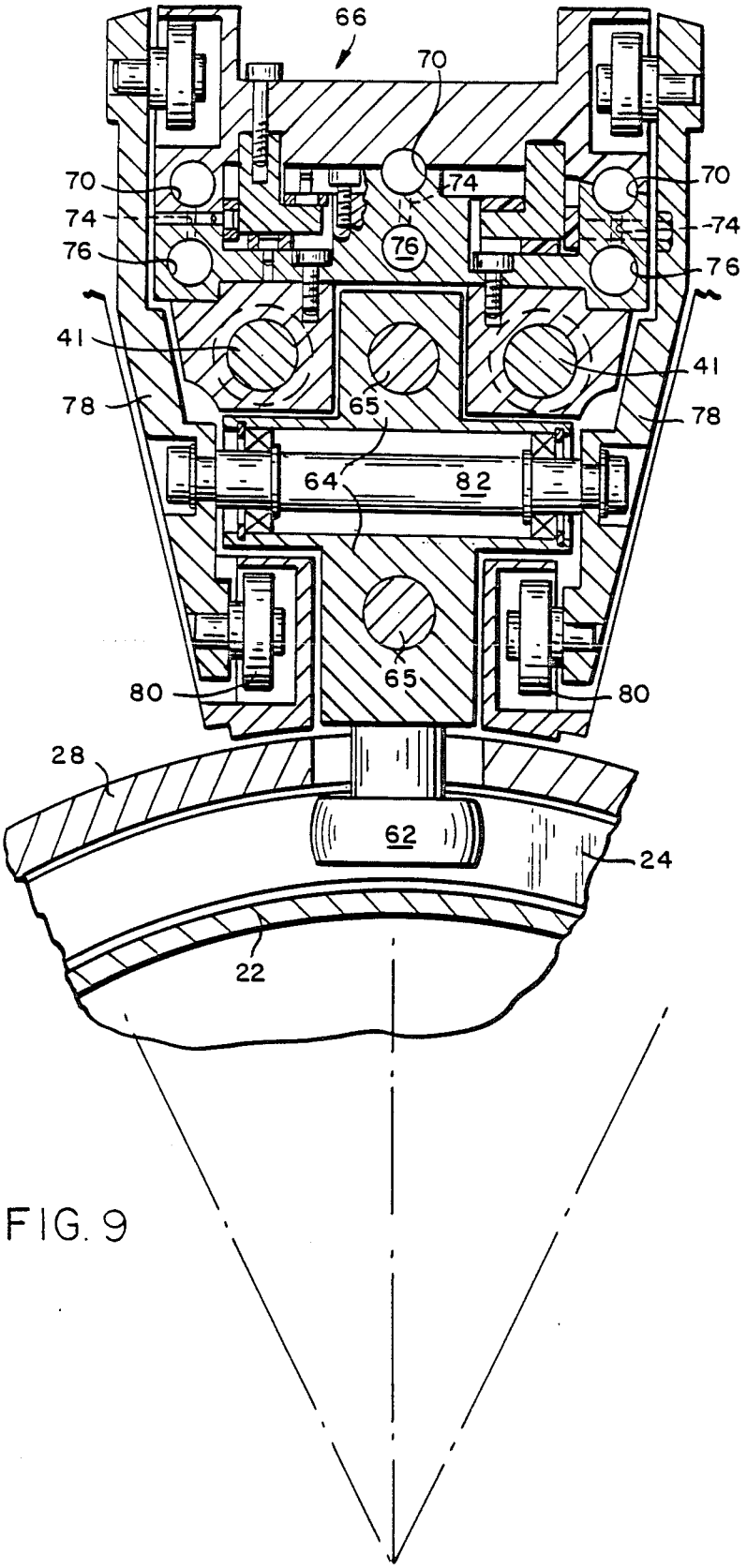
FIG. 9 is a fragmentary section taken along the line 9—9 of FIG. 6.

Each carriage 60 includes a first support area, defined by three outwardly-facing recesses 70 (FIGS. 6, 9 and 10), the axes of which coincide with the axes of the spindles 44. Recesses 70 are dimensioned to receive and support jacket segments "A" (FIG. 1), each preferably comprising a jacketed rod 2 of tobacco, at one end of which is the sleeve 3 of insulating fibers surrounding a plastic tube 4. See FIG. 8. Each clamp 66 also has complementary recesses of the same dimensions as recesses 70 which are aligned with and cooperate with recesses 70 to restrain movement of the jacket segment. The retaining member 67 on clamp 66 has openings 71 aligned with the recesses. Openings 71 are dimensioned to restrain lateral movement of the jacket segment but to permit the aerosol generating cartridges to pass through to be inserted into the jacket segments.

At the spindle end of recesses 70 is a retaining plate 75 to restrain lateral movement of the jacket segment when it is impaled onto the cartridge. Retaining plate 75 has holes 73 aligned with recesses 70 and dimensioned to permit the spindle 44 to pass through to make a passage in jacket segment and to permit tube 4 to pass through to be ejected from the jacket segment while restraining movement of the jacket segment toward the spindle.

Each carriage 60 also includes a second support area defined by three outwardly-facing recesses 72 which are concentric with recesses 70, and which are dimensioned to receive and support the aerosol generating cartridges "B" (FIG. 2), each preferably comprising capsule 5, at one end of which is the heat-generating element 7, in alignment with the axes of the jacket segments. See FIG. 8.

Each cylindrical recess 70 contains a plurality of orifices 74 which are in communication with a passage 76 extending lengthwise of the carriage, and mounted in end plate 39, 40 in flow communication with the passageways therein. Each recess 72 is also provided with a plurality of orifices 74 in communication with the passage 76. Orifices 74 provide vacuum for holding the components in the recesses 70 and 72 in axial alignment and also provide bursts of low pressure air at suitable intervals to remove any debris from the recesses.

In the preferred embodiment, grooves 84 and 86 in mounting plate 12 provide communication to vacuum chamber 25 to provide vacuum to orifices 74 and openings 85 and 87 in mounting plate 12 provide low pressure air to orifices 74, as illustrated in FIG. 13 with reference to the position of the transfer drums. Preferably, low pressure air is provided at about 4 barr and vacuum is provided at about 70 to 80 mbarr.

In the illustrated embodiment, each station also includes three abutment members 68, one for each of the modules to be assembled at that station. The abutment members 68, FIGS. 5 and 8, are bolted to brackets 69 slidably mounted to an end plate 39, 40, and are movable axially relative to the spindles 44. Each abutment member 68 is spring-biased by spring 300 (FIG. 8), and is held retracted by a latch 90 engaged at 92 with extension 93 of bracket 69 (FIG. 7), and is released at appropriate times as will appear hereinafter. Latch 90 is pivotally mounted on a support member 91, which is mounted on the end plate 39, 40. See FIG. 7. Movement of the latch 90 is effected by engagement of a cam follower 100 mounted thereon with the profile cam surface 26 at the end of the cam sleeve 22.

In operation, as the assembly drum 27 rotates, a jacket segment "A" is placed in a recess 70 (FIG. 5), preferably by transfer drum D1. Due to the action of coupling member 64, following cam groove 24, and support arms 78, the clamp 66 is moved relative to the carriage 60 toward the spindle 44 to enclose the jacket segment A in recess 70. Thereafter, the clamp and carriage move in unison toward the rotating spindle due to the action of coupling member 64 following cam groove 24, to impale the jacket segment A, restrained by retaining member 67, on the spindle 44. At this position, an aerosol generating cartridge "B" (FIG. 2) is placed on the carriage in the recess 72, preferably by transfer drum D2 (FIG. 4). Following deposit of the cartridge "B" on the carriage, the abutment member 68 is released by the latch 90, due to the contour of cam surface 26, so that the abutment member is moved into engagement with the cartridge "B" and pushes it against jacket module A. See FIG. 8.

Movement of the clamp 66, together with the carriage 60, away from the spindle 44, as effected by coupling member 64 in combination with cam groove 24, withdraws jacket segment A and the pierced rod of tobacco 2 from the spindle and, with the aid of abutment member 68, impales the jacket segment A on the cartridge "B" disposing the capsule 5 within rod 2 and the fuel element 7 within sleeve 3 as shown in FIG. 3. During this movement, the plastic tube support member for sleeve 3 is held between capsule 5 and the shoulder 45 on the conical tip 46 of spindle 44, and is eventually ejected from sleeve 3 by passage through the pierced tobacco rod 2. Retaining member 67 has a hole 71 of sufficient size to permit the cartridge "B" to pass through and to restrain axial movement of jacket segment A when it is impaled on the spindle. Further movement of the clamp 66 and carriage 60 relative to the abutment member 68 removes clamp 66 from the resulting aerosol generating module "M" (FIG. 3) and reengages the latch 90 with the abutment member 68. The aerosol generating module "M" is then removed from the carriage by disengagement of the vacuum and transfer to transfer drum D3 (FIG. 4).

FIGS. 11-A to 11-H and 12-A through 12-0 schematically depict the sequence of operation of the stations on assembly drum 27. FIGS. 11-A to 11-H diagramatically show the interaction of carriages 60.1 with cam surfaces 24.1 and 26.1 and the relative movements of the carriages 60.1, the clamps 66.1 and the abutment members 68.1. FIGS. 12-A through 12-0 diagramatically show the movements of clamps 66.1, carriages 60.1 and abutment members 68.1 for the illustrated preferred embodiment which makes three aerosol generating modules at each station. These figures are presented solely for the purpose of illustrating relative movements and relative positions of the various parts of the carriages as shown.

FIGS. 11-A and 12-A show the clamp 66.1 displaced away from the spindles, for loading jacket segments A. At this position, the recesses 70.1 on the carriage 60.1 are exposed. Jacket segments A, preferably comprising a rod of tobacco, the sleeve of insulating fibers and the support tube, are now deposited in the recesses 70.1, as shown in FIGS. 11-B and 12-B, in alignment with the axis of the spindles 44.1. The clamp 66.1 is now moved by the are 78.1, by movement of coupling member 64.1 in conjunction with cam follower 62.1 following cam groove 24.1, as shown in FIG. 11-C, to a position to enclose the jacket segments A in recesses 70.1. See FIGS. 12-C and D.

Following movement of the clamp relative to enclosing segments A, the carriage 60.1 is moved toward the spindles, by means of coupling member 64.1 and cam follower 62.1 in conjunction with cam groove 24.1. Carriage 60.1 carries with it jacket segments A, enclosed by the clamp 66.1, to a position to impale the jacket segments on the rotating spindles 44.1, as shown in FIGS. 11-D, 12-E and 12-F. At this position (FIGS. 11-D and 12-F), the recesses 72.1 are exposed between the clamp 66.1 and the abutment members 68.1.

The cartridges B, comprising the capsule and fuel element, are now deposited between the clamp 66.1 and the abutment members 68.1 (FIG. 11-E and 12-G) with the fuel elements facing abutment members 68.1. The abutment members are then released by retraction of the latch 90.1 through the action of cam follower 100.1. Thus the spring biased abutment members move into engagement with the cartridges "B" and press the latter into engagement with jacket segments A (FIG. 11-F and 12-H).

Now the carriage 60.1 and clamp 66.1 are moved away from the spindles, which withdraws the jacket segments A from the spindles, expels the tubes 4 after passing through the openings in the tobacco rods, and impales the jacket segments A on the cartridges "B" (FIG. 11-G, 12-I to J). Finally, the carriage 60.1, clamp 66.1 and abutment members 68.1 are moved to their initial positions, as shown in FIGS. 11-H and 12-K to O, to free the composite structures "M" for pickoff, and to reengage latch 90.1.

Thus, in sequence, the aforesaid apparatus operates to pierce a rod of tobacco, one end of which has been attached to a sleeve of insulating fibers disposed about a plastic tube, to form a longitudinal passage through the rod of tobacco corresponding to the inside diameter of the sleeve, and thereafter insert an aerosol generating cartridge into the formed passage and the sleeve.

It should be understood that the present disclosure is for the purpose of illustration only and the invention includes all modifications or improvements which are within the scope of the appended claims. The invention is not limited by particular materials, which are described only for purposes of illustration. For example, other materials may be used to form the jacket segment in place of tobacco and glass fibers, such as other fibrous materials and/or non-fibrous materials. Materials other than fibrous materials may also be used to form the sleeve. Other configurations of the aerosol generating cartridge may be employed.

It should also be understood that those skilled in the art, upon considering the present disclosure including the drawings, can readily modify the apparatus to insert cartridges in a sleeve (i.e. without a spindle), to make more or less aerosol generating modules simultaneously at each station, etc.

What is claimed is:

1. Apparatus for making aerosol generating modules for smoking articles, the apparatus comprising: a rotatable drum; a plurality of stations mounted on the drum, each station comprising jacket holding means for receiving and holding at least one jacket segment and cartridge holding means for receiving and holding at least one aerosol generating cartridge; and means for inserting the cartridges into the jacket segments.

2. The apparatus of claim 1 wherein the stations are arranged in axially aligned pairs.

3. The apparatus of claim 1 or 2 wherein each station includes means for inserting.

4. The apparatus of claim 1 or 2 wherein each station comprises passage forming means for forming a passage lengthwise through at least a portion of each jacket segment.

5. The apparatus of claim 4, wherein each station further comprises means for ejecting a support member from within the jacket segment.

6. The apparatus of claim 4 wherein the passage forming means comprises a passage forming member, each station further comprising means for withdrawing the passage forming member from each jacket segment and simultaneously inserting an aerosol generating cartridge into the jacket segment.

7. The apparatus of claim 6, each station further comprising means for ejecting a support member from within the jacket segment.

8. The apparatus of claim 7, wherein the means for simultaneously withdrawing the passage forming member and inserting the cartridge includes the means for ejecting the support member.

9. The apparatus of claim 1 or 2 wherein each station further comprises means for ejecting a support member from within the jacket segment.

10. The apparatus of claim 9 wherein each station further comprises means for simultaneously inserting an aerosol generating cartridge into the jacket segment while the support member is being ejected.

11. The apparatus of claim 1 or 2 wherein at each station the jacket holding means is in axial alignment with the cartridge holding means.

12. The apparatus of claims 1 or 2 wherein each station further comprises: a slidable support means having thereon the jacket holding means and the cartridge holding means; and means cooperating with the jacket holding means for restraining movement of the jacket segment during insertion.

13. The apparatus of claim 12 wherein the insertion means comprises: an abutment member proximate the cartridge holding means; and means for effecting relative movement between the slidable support means and the abutment member to insert the cartridge into the jacket segment.

14. The apparatus of claim 12 wherein the insertion means comprises an abutment member proximate the cartridge holding means and means for moving the slidable support means toward the abutment member to effect the insertion of the cartridge into the jacket segment.

15. The apparatus of claim 12 further comprising means for restraining movement of the abutment member while the support means is moving toward the abutment member to effect insertion of the cartridge into the jacket.

16. The apparatus of claim 12, wherein each station comprises passage forming means for forming a passage lengthwise through at least a portion of each jacket segment.

17. The apparatus of claim 1 or 2 wherein each station further comprises: a support means having fixed thereto the jacket holding means and the cartridge holding means; and means cooperating with the jacket holding means for restraining movement of the jacket segment during insertion; and wherein the insertion means comprises: an abutment member proximate the cartridge holding means; and means for effecting relative movement between the support means and the abutment member to insert the cartridge into the jacket segment.

18. The apparatus of claim 17, wherein each station comprises passage forming means for forming a passage lengthwise through at least a portion of each jacket segment.

19. The apparatus of claim 1 or 2 wherein each station comprises a plurality of corresponding jacket holding and cartridge holding means.

20. The apparatus of claim 1 or 2 wherein each station comprises passage forming means for forming a passage lengthwise through at least a portion of each jacket segment;

a slidable support means which carries the jacket holding means and cartridge holding means, the jacket holding means being mounted proximate to the passage forming means; the jacket holding means comprises a first recess shaped to receive a jacket segment, and the cartridge holding means comprises a second recess adjacent to the first recess and shaped to receive a cartridge, the recesses being in axial alignment for insertion of the cartridge into the jacket segment; the jacket holding means further including means for restraining movement of the jacket segment during passage formation and insertion; the passage forming means comprising a spindle in axial alignment with the recesses; the insertion means comprises an abutment member proximate the cartridge holding means;

means for moving the slidable support means toward the spindle to effect formation of the passage in the jacket segment; and means for moving the support means away from the spindle, cooperating with means for restraining movement of the abutment member while the support means is moving away from the spindle, to withdraw the jacket segment from the spindle, engage the cartridge with the abutment member, and insert the cartridge into the jacket segment.

21. The apparatus of claim 20 wherein each station comprises a plurality of corresponding pairs of first and second recesses.

22. The apparatus of claim 20 wherein the spindle, the means for moving the support means away from the spindle, and the means for restraining movement of the abutment member comprise a means for ejecting a support member from within the jacket segment.

23. The apparatus of claim 1 or 3, wherein the jacket holding means and cartridge holding means are mounted adjacent each other on a support means, the jacket holding means includes a means for restraining movement of the jacket segment during insertion, the insertion means comprises an abutment member adjacent the cartridge holding means, and the apparatus further comprises means for effecting relative motion between the abutment member and the support means to effect insertion of the cartridge into the jacket segment.

24. The apparatus of claim 23 wherein the apparatus comprises passage forming means for forming a passage lengthwise through at least a portion of the jacket segment.

25. The apparatus of claim 24 wherein the passage forming means comprises a passage forming member and each station comprises means for withdrawing the passage forming member from the jacket segment and simultaneously inserting the aerosol generating cartridge.

26. The apparatus of claim 1 or 2 wherein the jacket segment comprises a sleeve of insulating material preformed about a tubular member and wherein the insertion means includes means for ejecting the tubular member from the sleeve.

27. The apparatus of claim 1 or 2 wherein the jacket segment comprises a rod of tobacco material and each station comprises passage forming means for forming a passage lengthwise in the rod.

28. Apparatus for making aerosol generating segments for smoking articles, said apparatus comprising:

a rotatable drum;

a plurality of stations located on the drum, each station comprising: jacket holding means for receiving and holding jacket segments; cartridge holding means for receiving and holding aerosol generating cartridges; and means for inserting the cartridges into the jacket segments, thereby forming aerosol generating modules;

jacket supply means for supplying jacket segments and cartridge supply means for supplying aerosol generating cartridges to each of the stations in seriatim; and means for removing the aerosol generating modules from each station, in seriatim.

29. The apparatus of claim 28 wherein the jacket supply means comprises a rotatable member.

30. The apparatus of claim 28 wherein the cartridge supply means comprises a rotatable member.

31. The apparatus of claim 28 wherein the stations are arranged in axially aligned pairs around the periphery of the drum.

32. The apparatus of claim 28 wherein each station comprises passage forming means for forming a passage lengthwise through at least a portion of each jacket segment.

33. The apparatus of claim 32 wherein each station further comprises means for ejecting a support member from within the jacket segment.

34. The apparatus of claim 32 wherein the passage forming means comprises a passage forming member, each station further comprising means for withdrawing the passage forming member from each jacket segment and simultaneously inserting an aerosol generating cartridge into the jacket segment.

35. Apparatus for assembling components of a smoking article, the apparatus comprising a rotatable drum containing a plurality of peripheral movably mounted supports for receiving first and second components in alignment; means associated with the drum and operable as the drum is rotated to form an axial passage in one component and impale the first component on the second component to produce a composite structure.

36. Apparatus according to claim 35 wherein there are peripherally-spaced spindles on the drum aligned with the supports and movable clamps associated with the supports for enclosing the first components on the supports and moving them onto the spindles and thereafter removing pierced first components from the spindles and impaling them on the second components.

37. Apparatus according to claim 35 wherein the means for forming the axial passage includes spindles in alignment with the supports and the supports comprise recesses for receiving the components and are movable in a first direction to impale the first components on the spindles and thereafter in a second direction to withdraw the first components from the spindles and impale them on the second components.

38. Apparatus according to claim 37 wherein there are abutment means for constraining axial movement of the second components as the first components are been impaled thereon.

39. Apparatus according to claim 35 wherein the supports on the drum are arranged in a series of adjacent axial pairs, and the drum further comprises a pair of opposite-facing spindles located between each pair of supports.

40. The apparatus of claim 39 wherein the supports are mounted in sets on slidably mounted carriages and each carriage has a slidably mounted clamp associated with it for enclosing first components on the support.

41. The apparatus of claim 35 wherein the means for forming the axial passages in the first components comprises pairs of opposite-facing spindles on the drum and wherein the supports are arranged in pairs on both sides of the spindles and comprise sets of axially aligned, corresponding recesses for first and second components.

42. The apparatus of claim 41 wherein the sets of recesses are located in groups on slidably mounted carriages and each carriage has a slidably mounted clamp associated with it for enclosing first components on the support.

43. The apparatus of claim 40 or 42 wherein the drum is mounted on a support member having a contoured cam groove and wherein the carriages and the clamps move in response to the contour of the cam groove.

44. The apparatus of claim 40 or 42 further comprising a releasable, slidable abutment member for constraining movement of the second components while the first components are being impaled on the second components.

45. The apparatus of claim 44 wherein the abutment member is released and latched in response to the contour of a cam surface on a support member for the rotatable drum.

46. The apparatus of claim 39, 40, 41 or 42, further comprising means for rotating the spindles.

47. The apparatus of claim 46 wherein the spindles are rotated by the rotation of the drum.

48. The apparatus of claim 47 wherein the means for rotating the spindles comprise gear means mounted between the pair of supports.

49. Apparatus for assembling components of a smoking article, the apparatus comprising a support member having contoured cam surfaces; and a rotatable drum mounted on the support member and having a plurality of movably mounted assembly stations arranged in tandem around the periphery of the drum, each station comprising a slidably mounted carriage having aligned sets of recesses for receiving a plurality of first and second components of the smoking article, a slidably mounted clamp associated with the carriage for enclosing the first components on the carriage, a slidable abutment member aligned with each set of recesses for constraining axial movement of a second component, and means responsive to cam surfaces on the support member to move the clamp relative to the carriage and abutment members to enclose the first components on the carriage, to move the abutment members from a retracted position to an engaged position for constraining axial movement of the second components on the carriage, to move the carriage and clamp toward the abutment members to insert the second components in the first components, to move the carriage relative to the clamp to release the assembled first and second components, and to move the abutment members from their engaged position to their retracted position.

50. Apparatus for assembling components of a smoking article, comprising a rotatable drum, a plurality of assembly stations mounted on the drum, each station comprising a spindle, means supporting the spindle for rotation about its longitudinal axis, a slidable abutment member, means supporting the abutment member in axially-spaced alignment with the axis of the spindle, a transport means comprising a reciprocal carriage having aligned recesses for receiving first and second components of the smoking article and a clamp movable in unison with the carriage relative to the spindle and the abutment member and movable relative to the carriage, the clamp being operable by movement relative to the carriage and abutment member to enclose a first component in the recess on the carriage for movement with the carriage in a direction toward the spindle into engagement with the spindle to pierce the first component and thereafter in an opposite direction toward the abutment member, initially in unison with the carriage to withdraw the pierced first component, from the spindle and impale it on the second component, and then relative to the carriage to release the composite structure comprising the first component with the second component contained therein, the abutment member being movable from a retracted position while the carriage is moving toward the spindle to an engaged position to restrain the second component while the carriage is moving away from the spindle and the first component is being impaled on the second component.

51. The apparatus of claim 50 wherein each station comprises an equal number of spindles, abutment members, and sets of aligned recesses for receiving first and second components, for the assembly of a plurality of corresponding components simultaneously at each station.

52. The apparatus of claim 50 wherein the stations are mounted in tandem pairs around the rotatable drum and wherein each station comprises an equal number of spindles, abutment members, and sets of aligned recesses for receiving first and second components, for the assembly of a plurality of corresponding components simultaneously at each station.

53. The apparatus of claim 52 wherein the spindles are rotatably mounted in opposite-facing pairs between the carriages of each tandem pair of stations and wherein the means for rotating the spindles comprise gear means mounted between the carriages of each tandem pair of stations.

54. Apparatus according to claim 50 wherein there are orifices in communication with the recesses and means connecting the orifices to a vacuum.

55. Apparatus according to claim 50 wherein there is cam-actuated means for effecting movement of the carriage relative to the spindle and for effecting movement of the clamp relative to the carriage.

56. Apparatus according to claim 50 wherein the abutment member is slidably mounted and is spring-biased toward the spindle and wherein the apparatus further comprises latch means to constrain movement of the abutment member prior to deposit of the second component on the carriage and means operable for releasing the latch means following deposit of the second component on the carriage, to permit the abutment member to engage the second component.

57. Apparatus according to claim 50 further comprising first supply means for depositing the first component on the carriage in its recess prior to movement of the clamp to the enclosing position and second supply means for depositing the second component on the carriage in its recess following movement of the carriage and clamp to the position of impalement of the first component on the spindle.

58. Apparatus for the manufacture of a smoking article, the apparatus comprising a rotatable drum, a plurality of stations mounted on the drum, each station comprising a spindle; an abutment member disposed in spaced alignment with the spindle; a carriage structured to support a first component comprising a jacketed rod of tobacco, at one end of which there is a sleeve of non-combustible material formed around a support member, in alignment with the spindle and the abutment member; and means for effecting movement of the carriage in a direction toward the spindle to pierce the jacketed rod of tobacco; means for supporting a second component comprising an aerosol generating cartridge, at one end of which there is a fuel element, on the carriage between the first component and the abutment members, for constraining movement of the second component relative to the carriage; and means for moving the carriage in a direction away from the spindle to withdraw the fist components from the spindle, impale it on the second component and expel the support member.

59. Apparatus for making smoking articles, the apparatus comprising a drum rotatable about a horizontal axis, a series of spindles mounted on the drum for rotation about horizontal axes parallel to the axis of rotation of the drum, a drive shaft supported by the drum for rotation about a horizontal axis parallel with the axes of the spindles; a train of gears operable by rotation of the drive shaft to effect rotation of the spindles; means for effecting rotation of the drive shaft by rotation of the drum; an abutment member mounted on the drum in axially-spaced alignment with each spindle; a carriage structured to support first and second components positioned between and in alignment with a corresponding number of spindles and abutment members, the carriage being mounted on the drum for reciprocal movement relative to and parallel to the axes of the spindle and the abutment member; and means operable by rotation of the drum to effect reciprocal movement of the carriage to move the carriage in a direction to impale first components on the spindles and in the opposite direction toward the abutment member to withdraw the first components from the spindles and move them toward the abutment members to impale the pierced first components on second components supported by the carriage and constrained by abutment members.

60. Apparatus according to claim 59 wherein there is a clamp mounted on the carriage for movement therewith and relative thereto, to enclose and release the first component on the carriage, and cam-actuated means for effecting movement of the clamp.

61. Apparatus according to claim 59 or 60 wherein the carriage embodies recesses for receiving the first and second components and vacuum means for restraining movement of the components within the recesses.

62. Apparatus according to claim 61 wherein there are a plurality of sets of recesses on the drum and a spindle and abutment member mounted to the drum in peripherally-spaced relation about the axis of rotation of the drum corresponding to each set of recesses.

63. Apparatus according to claim 59 comprising means yieldably biasing the abutment member in a direction toward the spindle, a latch constraining movement of the abutment relative to the carriage and means for releasing the latch following deposit of the second component on the carriage.

64. Apparatus according to claim 59 comprising means for retracting the abutment member relative the carriage to facilitate placing the second component on the carriage between the abutment member and the first component.

65. Apparatus for making smoking articles, the apparatus comprising a support frame; a drum disposed on the frame for rotation about a horizontal axis; a spindle mounted to the drum for rotation therewith about a horizontal axis spaced from and parallel to the axis of rotation of the drum; spindle rotating means operable by rotation of the drum relative to the frame to effect rotation of the spindle; an abutment member mounted to the drum in axially-spaced alignment with the spindle; a carriage movably mounted to the drum between the spindle and the abutment member and in alignment therewith; carriage movement means on the frame and drum cooperable by rotation of the drum relative to the frame to effect movement of the carriage to move a component supported by the carriage onto the spindle to pierce the same and to withdraw the pierced component from the spindle and impale it on a second component supported by the carriage between the first component and the abutment member.

66. Apparatus according to claim 65 wherein the spindle rotating means for effecting rotation of the spindle comprises a ring gear mounted to the frame, a spur gear mounted to the drum in mesh with the ring gear and meshing gears, one of which is engaged with the spur gear and another of which is mounted to the spindle.

67. Apparatus according to claim 66 wherein the carriage movement means comprise a cam cylinder containing a cam groove mounted to the frame and a cam follower mounted on the carriage for engagement with the cam groove.

68. Apparatus according to claim 67 wherein the cam cylinder is provided with a profile cam at one end and a lever is pivotally mounted to the frame with one end engaged with the profile cam and the other end engageable at times with the abutment member to effect retraction and release of the abutment member and there is spring means for yieldably holding the abutment member in contact with the profile cam.

69. Apparatus for making smoking articles comprising a first component comprising a rod of tobacco, at one end of which there is a sleeve of non-combustible material and a second component comprising an aerosol generating cartridge, the apparatus comprising a frame; a drum disposed on the frame for rotation about a horizontal axis; circumferentially-spaced spindles mounted to the drum about the axis of rotation of the drum; means operable by rotation of the drum relative to the frame to effect rotation of the spindles; an abutment member mounted to the drum in axial alignment with each spindle; carriages slidably mounted to the drum between the spindles and abutment members structured to receive the components in alignment with a spindle and an abutment member; and means for effecting axial movement of each carriage relative to the aligned spindle and abutment member to move the first component onto the spindle to pierce the same and then from the spindle and onto the second component to dispose the first component on the second component.

70. Apparatus according to claim 69 wherein the means for effecting axial movement of the carriages comprise a cam cylinder mounted to the frame and a cam follower mounted to each carriage in engagement with the cam cylinder, operable by relative rotation of the frame and drum to effect reciprocal movement of the carriages.

71. Apparatus according to claim 70 wherein each carriage embodies first and second concentric recesses for receiving, respectively, the first and second components, the apparatus having means for depositing the first components on the carriage; and means for depositing the second component on the carriage while the first component is on the spindle.

72. Apparatus according to claim 70 wherein the cam cylinder embodies a cam groove and the cam follower is in the groove.

73. Apparatus according to claim 72 wherein the cam cylinder further comprises a cam track, wherein the abutment members are spring-biased toward the spindles, wherein there are latch means constraining movement of the abutment members, and wherein there are cam levers yieldably engaged with the cam track operable at times to release the abutment members.

74. The apparatus of claim 69, 70, 71 or 73 wherein the spindles, abutment members, and carriages are arranged in tandem around the drum, the spindles are arranged in opposite-facing pairs located between tandem carriages, and each carriage is structured to receive a plurality of first and second components, for the assembly of a plurality of corresponding components of smoking articles simultaneously on each carriage.

* * * * *